US007642996B2

(12) United States Patent
Salata

(10) Patent No.: US 7,642,996 B2
(45) Date of Patent: Jan. 5, 2010

(54) METHOD OF DRIVING AN ORGANIC ELECTROLUMINESCENT DEVICE COMPRISING A PHOSPHORESCENT LIGHT EMITTER

(75) Inventor: Oleg Victorovich Salata, Oxford (GB)

(73) Assignee: ISIS Innovation Limited, Oxford (GB)

( * ) Notice: Subject to any disclaimer, the term of this patent is extended or adjusted under 35 U.S.C. 154(b) by 794 days.

(21) Appl. No.: 10/488,054

(22) PCT Filed: Aug. 27, 2002

(86) PCT No.: PCT/GB02/03916

§ 371 (c)(1),
(2), (4) Date: Jul. 20, 2004

(87) PCT Pub. No.: WO03/021563

PCT Pub. Date: Mar. 13, 2003

(65) Prior Publication Data

US 2006/0152165 A1 Jul. 13, 2006

(30) Foreign Application Priority Data

Aug. 28, 2001 (GB) ..... 0120828.9

(51) Int. Cl.
*G09G 3/30* (2006.01)

(52) U.S. Cl. ..... 345/76

(58) Field of Classification Search ..... 345/76–82; 252/301.16; 315/169.3; 313/463, 502–507; 428/690

See application file for complete search history.

(56) References Cited

U.S. PATENT DOCUMENTS

| | | | | |
|---|---|---|---|---|
| 3,908,150 | A | 9/1975 | Webb | |
| 4,839,463 | A | 6/1989 | Boudreau et al. | |
| 4,839,563 | A * | 6/1989 | Boudreau et al. | 315/169.3 |
| 6,002,206 | A | 12/1999 | Harrison et al. | |
| 6,013,384 | A * | 1/2000 | Kido et al. | 428/690 |
| 6,048,630 | A | 4/2000 | Burrows et al. | |
| 6,366,268 | B1 * | 4/2002 | Forrest et al. | 345/82 |
| 2002/0024513 | A1 * | 2/2002 | Kota et al. | 345/204 |
| 2004/0113124 | A1 * | 6/2004 | Christou et al. | 252/301.16 |

FOREIGN PATENT DOCUMENTS

| | | |
|---|---|---|
| EP | 0 843 504 A | 5/1998 |
| WO | WO 96/36959 | 11/1996 |
| WO | WO 98/55561 | 12/1998 |

(Continued)

OTHER PUBLICATIONS

Braun D: "Nanosecond Transient Electroluminescence From Polymer Light-Emitting Diodes", Applied Physics Letters, American Institute of Physics. New York. US, vol. 61, No. 26. Dec. 28, 1992; pp. 3092-3904: XP000334699.

(Continued)

*Primary Examiner*—Sumati Lefkowitz
*Assistant Examiner*—Rodney Amadiz
(74) *Attorney, Agent, or Firm*—Quarles & Brady LLP

(57) ABSTRACT

A method of driving an organic electroluminescent device comprising a phosphorescent light emitter having an excited state emission decay time $\tau$, which method comprises applying to the organic electroluminescent device a series of electrical pulses of duration $t_d$, such that the ratio $t_d/\tau$ is less than or equal to 0.1, at a frequency which is less than $1/\tau$.

12 Claims, 9 Drawing Sheets

FOREIGN PATENT DOCUMENTS

| | | |
|---|---|---|
| WO | WO 99/20081 | 4/1999 |
| WO | WO 00/18851 | 4/2000 |
| WO | WO 00/57676 | 9/2000 |
| WO | WO 00/70655 | 11/2000 |
| WO | WO 01/41111 A1 | 6/2001 |
| WO | WO 01 41111 A1 | 6/2001 |
| WO | WO 02/20692 | 3/2002 |
| WO | WO 02/066552 | 8/2002 |
| WO | WO 02/068560 | 9/2002 |

OTHER PUBLICATIONS

Adachi C, Baldo M, Forrest S R: "Electroluminescence mechanisms in organic light emitting devices employing a europium chelate doped in a wide energy gap bipolar conducting host", Journal of Applied Physics, vol. 87, No. 11, Jun. 1, 2000; pp. 8049-8055.

C.W. Tang et al, Organic electroluminescent diodes, Applied Physics Letters., vol. 51, Sep. 1987, pp. 913-915.

A.R. Brown et al, Optical spectroscopy of triplet excitons and charged excitations in poly (p-phenylenevinylene) light-emitting diodes, Chemical Physics Letters, vol. 210, Jul. 23, 1993, pp. 61-66.

R.C. Kwong et al., Efficient, Saturated Red Organic Light Emitting Devices Based on Phosphorescent Platinum (II) Porphyrins, Chem. Mater, vol. 11, No. 12, 1999, pp. 3709-3713.

C. Adachi et al, High-efficiency organic electrophosphorescent devices with tris (2-phenylpyridine) iridium doped into electron-transporting materials, Applied Physics Letter, vol. 77, No. 6, Aug. 7, 2000, pp. 904-906.

C. Adachi et al, High-efficiency red electrophosphorescence devices, Applied Physics Letters, vol. 78, No. 11, Mar. 12, 2001, pp. 1622-1624.

J. Kido et al, Electroluminescence in a Terbium Complex, Chemistry Letters, 1990, pp. 657-660.

J. Kido et al, Electroluminescence from Polysilane Film Doped with Europium Complex, Chemistry Letters, 1991, pp. 1267-1270.

S. Capecchi et al, High-Efficiency Organic Electroluminescent Devices Using an Organoterbium Emitter, Advanced Materials, vol. 12, No. 21, Nov. 2, 2000, pp. 1591-1594.

V. Christou et al., Recent Developments In Oled Technology: Organolanthanide, Abstract Paper from American Chemical Society, vol. 219, U229 (2000).

J.J. Freeman et al., Spectra and Decay times of the Luminescences Observed From Chelated Rare Earth Ions, J. Physics Chemistry, vol. 67, Dec. 1963, pp. 2717-2723.

M.A. Baldo, et al, Phosphorescent materials for application to organic light emitting devices, Pure Appl. Chem., vol. 71, No. 11, 1999, pp. 2095-2106.

Yuguang Ma, et al, Electroluminescence from triplet-metal-ligand charge-transfer excited state of transition metal complexes, Synthetic Metals, vol. 94, 1998, pp. 245-248.

M. Klessinger and J. Michl, Unimolecular Deactivation Processes, Excited States and Photochemistry of Organic Molecules, VCH, 1995, pp. 245-246.

Search Report for GB 0120828.9 dated Apr. 30, 2002.

* cited by examiner

METHOD OF DRIVING AN ORGANIC ELECTROLUMINESCENT DEVICE COMPRISING A PHOSPHORESCENT LIGHT EMITTER

CROSS-REFERENCE TO RELATED APPLICATIONS

The present application claims priority of International Patent Application PCT/GB02/03916, filed on 27 Aug. 2002, which claims priority of GB Patent Application 0120828.9, filed on 28 Aug. 2001.

The present invention relates to a method of driving an organic electroluminescent (EL) device.

Emission of a photon from an electronically excited state is referred to as luminescence. Electroluminescence occurs when the excitation is produced by the application of an electric field. Photoluminescence occurs when the excitation is produced by the application of light. Electroluminescence in thin organic films and organic light emitting diodes (OLEDs) that are based on this phenomenon constitute a rapidly growing field of research.

Fluorescence and phosphorescence can be differentiated depending on whether the transition is between states of equal multiplicity, and thus spin-allowed, or between states of different multiplicity, and thus spin-forbidden. Initial efforts were concentrated on the utilisation of fluorescent materials to produce light emission (see C. W. Tang et al., Appl. Phys. Lett. 51, 913 (1987)). However, although fluorescent materials are highly efficient in photoluminescence, only one quarter or so of the total excitations are converted into light in EL devices due to the spin statistics (see A. R. Brown et al., Chem. Phys. Lett. 210, 61 (1993)). The recent success of phosphorescent materials containing transition metals in overcoming the singlet-triplet bottleneck has pushed up both the practical and theoretical limits of OLED performance (see R. C. Kwong et al., Chem. Mater. 11, 3709 (1999); C. Adachi et al., Appl. Phys. Lett. 77, 904 (2000); C. Adachi et al., Appl. Phys. Lett. 78, 1622 (2001)).

Another group of organic electroluminescent materials which have been investigated are the organolanthanide phosphors (OLPs) (see, for example, J. Kido et al., Chem. Lett., 657 (1990); J. Kido et al., Chem. Lett., 1267 (1991); S. Capecchi et al., Adv. Mater. 12, 1591 (2000); V. Christou et al., Abstr. Pap. Am. Chem. Soc. 219, U229 (2000)). "OLP" is a UK registered trade mark of Opsys Limited. The OLPs have the same benefits as phosphorescent materials containing transition metals in converting both singlet and triplet excitons into photons, and in addition they have extremely narrow spectral emission (see J. J. Freeman et al., J. Phys. Chem. 67, 2717 (1963)).

In principle, organic electroluminescent devices containing OLP emitters should have the potential for high efficiency. However, to date the practical performance of such devices has been limited. When OLPs are compared with the best phosphorescent materials in EL devices their efficiency at practical luminance level is significantly below theoretical expectations. The maximum brightness achieved from an OLP device is much less than from a similar fluorescent EL device. Triplet-triplet (T-T) annihilation has been suggested as the mechanism responsible for a marked drop in OLP device efficiency at higher current densities (see C. Adachi et al., J. Appl. Phys., 87, 8049 (2000)).

Surprisingly, the present inventor has found that the efficiency of an organic electroluminescent device comprising a phosphorescent emitter at a given current density can be improved relative to the steady state case by driving the device using electrical pulses which are of substantially shorter duration than the excited state emission decay time of the phosphorescent emitter.

The present invention accordingly provides a method of driving an organic electroluminescent device comprising a phosphorescent light emitter having an excited state emission decay time $\tau$, which method comprises applying to the organic electroluminescent device a series of electrical pulses of duration $t_d$, such that the ratio $t_d/\tau$ is less than or equal to 0.1, at a frequency which is less than $1/\tau$.

The method of the present invention is applicable to both actively and passively addressed organic electroluminescent displays. In an actively addressed display, each pixel of the display is addressed independently. In a passively addressed display, each row of the display is addressed in turn, so that each row is addressed for only a fraction of the total frame time. As they are addressed for a smaller proportion of the time, the individual pixels of a passively addressed display must reach a higher peak brightness in order to give the same overall display brightness as a corresponding actively addressed display. A higher peak current density is therefore required. The method of the present invention is particularly applicable to passively addressed displays because the improvement in efficiency obtained by using short pulse driving is particularly significant at higher current densities.

In a conventional passively addressed organic electroluminescent display, the dwell time, $t_d$, is typically about 100 μs for a display with 100 rows and a refresh rate, f, of 100 Hz. Sufficient light has to be emitted as a result of this electrical pulse of duration $t_d$ for the average brightness over the whole frame time to be sufficient.

When a fluorescent light emitter is used, the excited state lifetime of the emitter, $\tau$, is typically of the order of nanoseconds. This is much less than the dwell time, $t_d$. Light is effectively only emitted during the voltage or current pulse. In these circumstances, where $\tau$ is much less than $t_d$, for a passively addressed display with N rows, the following equations are found to apply:

$$\text{average brightness}=\text{peak brightness}/N,$$

$$\text{average brightness}=\text{peak brightness}\times f\times t_d, \quad (1)$$

so if N=100, and the desired average brightness is 100 $cdm^{-2}$, then the peak brightness needs to be 10,000 $cdm^{-2}$. In this case the average brightness is proportional to the dwell time, longer pulses generating more light.

Organic electroluminescent displays based on fluorescent light emitting polymers have been shown to have very high peak brightness when driven in conventional pulsed mode, and as such they can be used in passive matrix addressed displays. In these materials the light output is proportional to the current even at high current densities, allowing the necessary high peak brightness to be achieved.

In contrast, when organic electroluminescent devices based on phosphorescent light emitters such as OLPs are run in the steady state mode, the light output is not proportional to the current density; In fact the quantum efficiency, i.e. the ratio of time averaged light emission to time averaged current density, drops off markedly with increasing current density. Likewise, when the devices are driven in a conventional pulsed mode with, say, pulses of duration 100 μs, the quantum efficiency decreases markedly with increasing current density.

In view of the marked decrease in quantum efficiency at high current densities, phosphorescent compounds have previously been considered unsuitable as light emitters for displays where high peak brightness is required, such as passively addressed organic electroluminescent displays. However, in accordance with the present invention, the quantum efficiency may be improved by driving an organic electroluminescent device comprising a phosphorescent light emitter using electrical pulses which are of short duration compared with the excited state emission decay time of the phosphorescent emitter.

Any phosphorescent light emitter may be used in the method of the present invention. Phosphorescence generally occurs in complexes where there is strong spin-orbit coupling, for example in complexes containing a heavy element, such as a lanthanide metal, or a metal of the second or third row of the d-block of the Periodic Table (see *Inorganic Chemistry*, Shriver et al., Oxford University Press, 1990). Examples of suitable metals for phosphorescent complexes include lanthanide metals such as cerium, samarium, europium, terbium, dysprosium or thulium, and d-block metals such as iridium, platinum, rhodium, osmium, ruthenium or rhenium.

Phosphorescent lanthanide metal complexes such as the OLPs generally require one or more sensitizing groups that have the triplet excited energy level higher than the first excited state of the metal ion. Emission is from an f-f transition of the metal and so the emission colour is determined by the choice of the metal. The emission lifetimes of OLPs are relatively long, making the method of the present invention particularly appropriate for this class of compounds. Suitable coordinating ligands for the lanthanide metals include oxygen or nitrogen donor systems such as carboxylic acids, 1,3-diketonates, hydroxycarboxylic acids, and Schiff bases including acyl phenols and iminoacyl groups.

Some examples of lanthanide metal complexes which may be used in the present invention are described in WO 98/55561, WO 00/18851, UK Patent Application No. 0022081.4 and UK Patent Application No. 0104700.0.

Suitable phosphorescent compounds containing heavy d-block metals include, for example, organometallic complexes with carbon or nitrogen donors such as porphyrin, 2-phenylpyridine, 2-thienylpyridine, benzo(h)quinoline, 2-phenylbenzoxazole, 2-phenylbenzothiazole or 2-pyridylthianaphthene. There can also be optional substituents on the (hetero)aromatic rings.

Some examples of phosphorescent compounds containing heavy d-block metals which may be used in the present invention are described in U.S. Pat. No. 6,048,630, WO 00/57676, WO 00/70655, WO 99/20081, Pure Appl. Chem. 71 (11), 2095-2106 (1999), and Synthetic Metals, 94, 245-248 (1998).

It should be noted that phosphorescence is not necessarily due to small molecules. For example, the phosphorescent light emitter used in the present invention may be a dendrimer or may be polymeric.

The phosphorescent light emitter used in the present invention is preferably an organolanthanide phosphor compound, particularly an organolanthanide phosphor compound of formula (I):

$$M^{3+}(L^{n-})_xA_y \quad (I)$$

in which $M^{3+}$ is a trivalent lanthanide metal ion, $L^{n-}$ is an anionic ligand such that n.x is 3, A is an electrically neutral co-ligand which may be monodentate or bidentate, and y is 0, 1 or 2.

In one preferred embodiment, $L^{n-}$ is a 1,3-dicarboxylate ligand of formula (II):

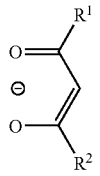

(II)

in which $R^1$ and $R^2$, which may be the same or different, are chosen from alkyl (preferably having from 1 to 6 carbon atoms) which is unsubstituted or is substituted by halogen, aryl (preferably phenyl) which is unsubstituted or is substituted by halogen, thienyl, furanyl and pyridyl, n is 1, x is 3, M is europium, terbium, samarium or dysprosium, and A, if present, is a co-ligand such as 1,10-phenanthroline, bathophenanthroline, 2,2'-bipyridyl, a phosphine oxide derivative such as triphenyl phosphine oxide, water, an N-oxide, a terpyridine, or a tetraalkylethylenediamine.

Specific examples of $L^{n-}$ include anions of 2-thenoyltrifluoroacetone (TTA), benzoyltrifluoroacetone (BTFP), dibenzoylmethane (DBM), dithenoylmethane (DTP), and 2-furoyltrifluoroacetone (FTFA).

Specific resulting compounds of formula (I) include europium tris(2-thenoyltrifluoroacetone) 1,10-phenanthroline ($Eu(TTA)_3$phen), europium tris(benzoyltrifluoroacetone) 1,10-phenanthroline ($Eu(BTFP)_3$phen), and europium tris(2-thenoyltrifluoroacetone) bathophenanthroline.

In another preferred embodiment, $L^{n-}$ is a pyrazolone ligand of formula (III):

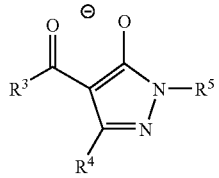

(III)

in which $R^3$, $R^4$ and $R^5$, which may be the same or different, represent hydrogen, an optionally substituted aromatic group or an optionally substituted aliphatic or cycloaliphatic group, such that at least one or $R^3$, $R^4$ and $R^5$ represents a said aromatic group which is conjugated with the pyrazolone ring system, n is 1, x is 3, and A, if present, is a co-ligand such as 2,2'-bipyridyl, or a phosphine oxide derivative (e.g. triphenyl phosphine oxide), or water.

Preferably $R^3$ is a branched alkyl group, $R^4$ is methyl, and $R^5$ is phenyl.

Specific examples include anions of 1-phenyl-3-methyl-4-(2-methylbutan-1-oyl)pyrazolin-5-one, 1-phenyl-3-methyl-4-(2,2-dimethylpropan-1-oyl)pyrazolin-5-one and other compounds described in UK Patent Application No. 0022081.4.

Specific resulting compounds of formula (I) include terbium tris(1-phenyl-3-methyl-4-(2-methylbutan-1-oyl)pyrazolin-5-one (Tb2B):

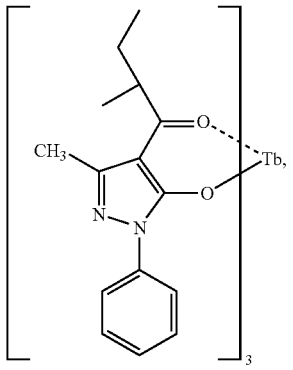

and other compounds described in UK Patent Application No. 0022081.4.

Other examples of suitable bidendate anionic ligands, $L^{n-}$, are known in the literature and include anions of carboxylic acids such as 2-(4'-methoxybenzoyl)benzoate. Alternatively multi-dentate ligands such as the trispyrazolylborate derivatives described in WO 98/55561 can be used.

Other examples of phosphorescent light emitters which may be used in the present invention include:

transition metal phosphorescent compounds such as 2,3,7,8,12,13,17,18-octaethyl-21H,23H-porphine platinum (II) (PtOEP):

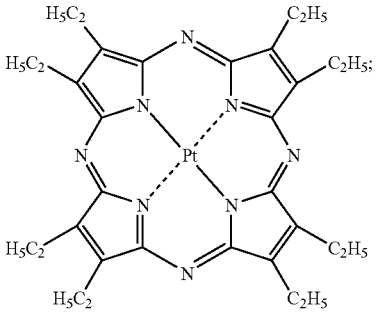

compounds described in UK Patent Application No. 0104175.5 such as 5,10,15,20-tetra[3',5'-di(3",5"-di-tert-butylstyryl)phenyl]porphyrinato platinum (II); and cyclometallated platinum compounds described in WO 00/57676 such as cis-bis[2-(2'-thienyl)pyridinato-N,$C^3$]Pt (II).

In a particularly preferred embodiment of the present invention, the phosphorescent light emitter is $Eu(TTA)_3$phen. This complex has an excited state emission decay time τ of about 0.5 ms.

The structure of the organic electroluminescent device used in the method of the present invention is not particularly limited, as long as it comprises a phosphorescent material as the light emitter. In its simplest form, the organic electroluminescent device can be formed from an organic layer comprising the phosphorescent material sandwiched between two electrodes, at least one of which is transparent to the emitted light. Such a device can have a conventional arrangement comprising a transparent substrate layer, a transparent electrode layer, a light emitting layer and a back electrode. For this purpose the standard materials can be used. The transparent substrate layer is typically made of glass although other transparent materials such as polyethylene terephthalate (PET), acrylic resins and polyamides such as nylon can also be used.

The transparent electrode which typically forms the anode is preferably made from indium tin oxide (ITO) although other similar materials including indium oxide/tin oxide, tin oxide/antimony and zinc oxide/aluminum can also be used. Conducting polymers such as PANI (polyaniline) can also be used.

The back electrode is normally made of a low work function metal or alloy such as Al, Ca, Mg, Li, or MgAg. As is well known, other layers may also be present, including a hole transporting material and/or an electron transporting material. In an alternative configuration, the substrate may be an opaque material such as silicon and the light may be emitted through the opposing electrode.

In general, if the spontaneous emission of radiation of the appropriate energy is the only pathway for an excited system with a large number of individual emitters to return to its initial state, then the rate of decay of emission from the system follows a first-order rate law and may be expressed as:

$$I=I_0\exp(-k_0t),$$

where $I_0$ is the intensity of radiative emission at time zero, I is the intensity of radiative emission at time t, and $k_0$ is a constant (see, for example, *Excited States and Photochemistry of Organic Molecules*, M. Klessinger and J. Michl, VCH, 1995, pages 245-246). In these circumstances, the mean natural lifetime of the excited state, $\tau_0$, is given by:

$$\tau_0=1/k_0,$$

although, in practice, each process competitive with spontaneous emission reduces the observed lifetime τ relative to the natural lifetime $\tau_0$.

The excited state emission decay time τ of the phosphorescent light emitter used in the present invention is defined by the equation:

$$I=I_0\exp(-t/\tau),$$

where $I_0$ is the observed intensity of phosphorescent emission from the excited emitter at time zero and I is the intensity of phosphorescent emission at time t. The excited state emission decay time τ may be measured by time-resolved spectrofluorimetry, for example using a Hitachi F4500 Scientific Fluorescence Spectrophotometer.

The excited state emission decay time τ of the phosphorescent light emitter used in the present invention is typically from 0.05 to 1 ms, preferably from 0.25 to 0.75 ms, more preferably about 0.5 ms.

The electrical pulses used in the method of the present invention may be voltage or current pulses. Current pulses are typically used. The pulses typically have a substantially rectangular form when the applied voltage or current is plotted as a function of time, although other pulse shapes may be used. The duration $t_d$ is equal to the full width at half maximum of the pulse, i.e. the time for the pulse to rise from 50% of its maximum value to 100% and to fall back to 50%.

Suitable drive pulses are at least an order of magnitude shorter than the excited state emission decay time, and are preferably at least two orders of magnitude shorter. The ratio $t_d/\tau$ is less than or equal to 0.1, preferably less than or equal to 0.05, and more preferably less than or equal to 0.01. The pulse duration $t_d$ is typically less than or equal to 50 μs, preferably less than or equal to 10 μs, more preferably from 1 to 5 μs.

For pulses lasting less than about 5 μs, the brightness of the electroluminescent emission is found to be proportional to the current density. The current density of the electrical pulses applied according to the present invention is not particularly limited, but the pulses are typically applied at a current density of up to 1 A/cm$^2$, preferably 0.1 to 500 mA/cm$^2$, more preferably 0.1 to 100 mA/cm$^2$.

For pulses lasting less than about 5 μs, the brightness is also found to be proportional to the pulse duration. However, when longer pulses are used, the quantum efficiency is not maintained (see FIGS. 5, 8 and 9 of the accompanying drawings). This is quite unlike the case with fluorescent emitters, where the quantum efficiency is independent of the pulse duration.

Although the drive pulses used according to the present invention are short, the relatively long excited state lifetime means that light continues to be emitted after the drive pulse has finished. The frequency at which the pulses are applied is less than $1/\tau$, preferably less than $0.5/\tau$, more preferably less than $0.1/\tau$. The frequency is typically from 10 Hz to 1 kHz, preferably from 20 to 200 Hz, more preferably from 50 to 100 Hz.

In a test device run at 100 Hz with 5 μs duration pulses, the average brightness of the device was 10 cd/m$^2$. As shown in FIG. 7 of the accompanying drawings, increasing the refresh rate, for example to 200, 500 or 1000 Hz, does not change the size or shape of the electroluminescent transient. However, the number of pulses per second is higher each time the refresh rate is increased, and hence the average brightness of the device is proportionately greater. Using short pulses at a moderate frequency thus provides a viable route to sufficiently bright devices.

It has previously been proposed that the decrease in efficiency with increasing current density in OLP EL devices is due to triplet-triplet annihilation. Triplet-triplet annihilation is a bimolecular process and hence is more pronounced at higher concentrations of triplets, for example at higher current density. In the short pulses used in the present invention the current density during the pulse is typically very high and a high density of triplets should therefore be formed. Unexpectedly, however, the sharp drop in efficiency that would indicate triplet-triplet annihilation is not seen (see FIGS. 4 and 6 of the accompanying drawings).

Previous passive matrix drive schemes have been developed for fluorescent systems with the refresh rate determined by the number of rows. However, when the emitter has a long excited state relative to the dwell time, then equation (1) is not appropriate. Instead, when $t_d$ is much less than $\tau$, assuming instantaneous charging of the excited state, theory predicts that the average brightness of a passive matrix display is:

$$\text{average brightness} = \text{peak brightness} \times f \times \tau, \quad (2)$$

which depends on the excited state lifetime rather than the dwell time. This equation should be borne in mind when designing a passive matrix addressing scheme for an organic electroluminescent device comprising a phosphorescent light emitter. However, the choice of pulse duration is also of relevance as the devices are more efficient when driven with shorter pulses.

The present invention will be further described in the Examples which follow, with reference to the accompanying drawings in which.

REFERENCE EXAMPLE 1

Preparation of Organic Electroluminescent Device

Indium tin oxide (ITO) coated glass supplied by the Applied Films Corporation was patterned by standard photolithography to produce a set of ITO stripes. The patterned substrates were sonicated in detergent, thoroughly rinsed with de-ionised water, blown with dry nitrogen and cleaned with oxygen plasma immediately before loading into a vacuum chamber. The base pressure of the vacuum system used for device fabrication (SPECTROS, KJ Lesker Limited, UK) was lower than $10^{-7}$ Torr. The device structure consisted of 50 nm of 4,4'-bis(N-(1-naphthyl)-N-phenylamino)biphenyl (α-NPD) as a hole transporting layer, 40 μm of 2-(4-biphenylyl)-5-(4-tert-butylphenyl)-1,3,4-oxadiazole (butyl-PBD) doped with 7.6 mol % of europium tris(2-thenoyltrifluoroacetone) 1,10-phenanthroline ($Eu(TTA)_3$ phen) as an emitting layer, 60 nm of 2,9-dimethyl-4,7-diphenyl-1,10-phenanthroline (BCP) doped with 50 mol % of Li as a hole blocking/electron transporting layer, and 100 nm of Al as a cathode.

REFERENCE EXAMPLE 2

Steady State Characteristics

Figure 1:
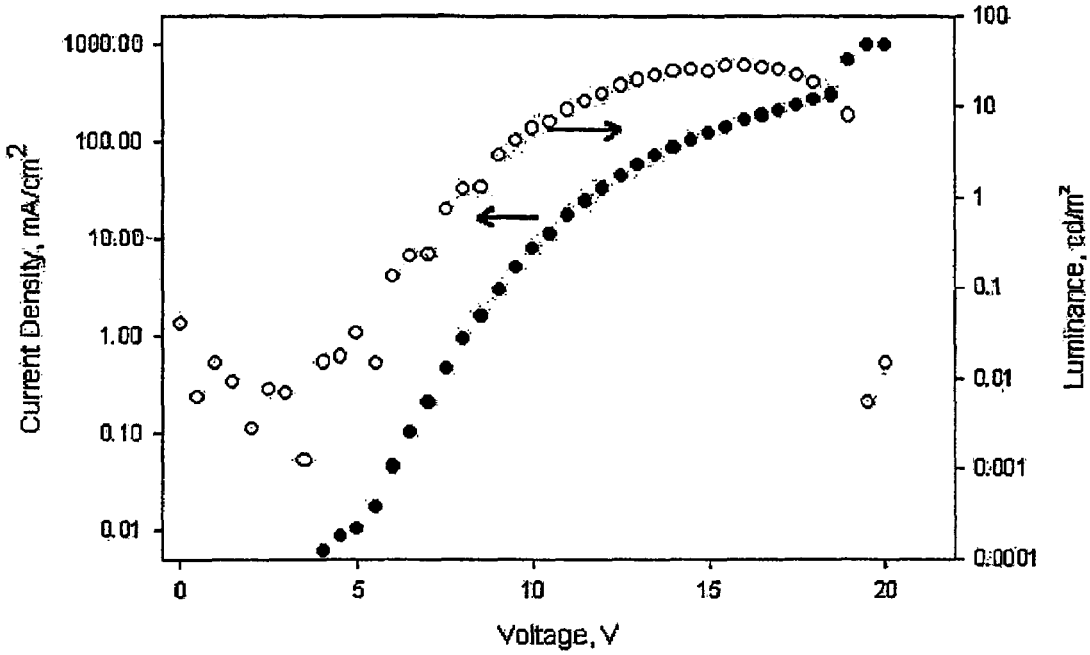
FIG. 1 illustrates the steady state current-voltage-luminance (J-V-L) characteristics of the organic electroluminescent device prepared in Reference Example 1.

The steady state J-V-L characteristics of the device prepared in Reference Example 1 are shown in FIG. 1 of the accompanying drawings. The device has a rather low quantum efficiency, the maximum being approximately 0.3 cd/A at 0.13 mA/cm$^2$. Although inefficient, the device is stable in ambient conditions under DC currents of up to 1 A/cm$^2$ and such currents can be reached at relatively low driving voltages.

EXAMPLE 1

The device prepared in Reference Example 1 was tested under pulsed current driving, using an AVTECH AV-1011B1-B pulse generator, a Tektronix TDS 3054 500 MHz digital storage oscilloscope and a Si photodiode were used. The time response of the system was better than 1 μs. A repetition frequency of 100 Hz (10 ms period) was chosen for these experiments as a typical display refresh rate.

Figure 2:
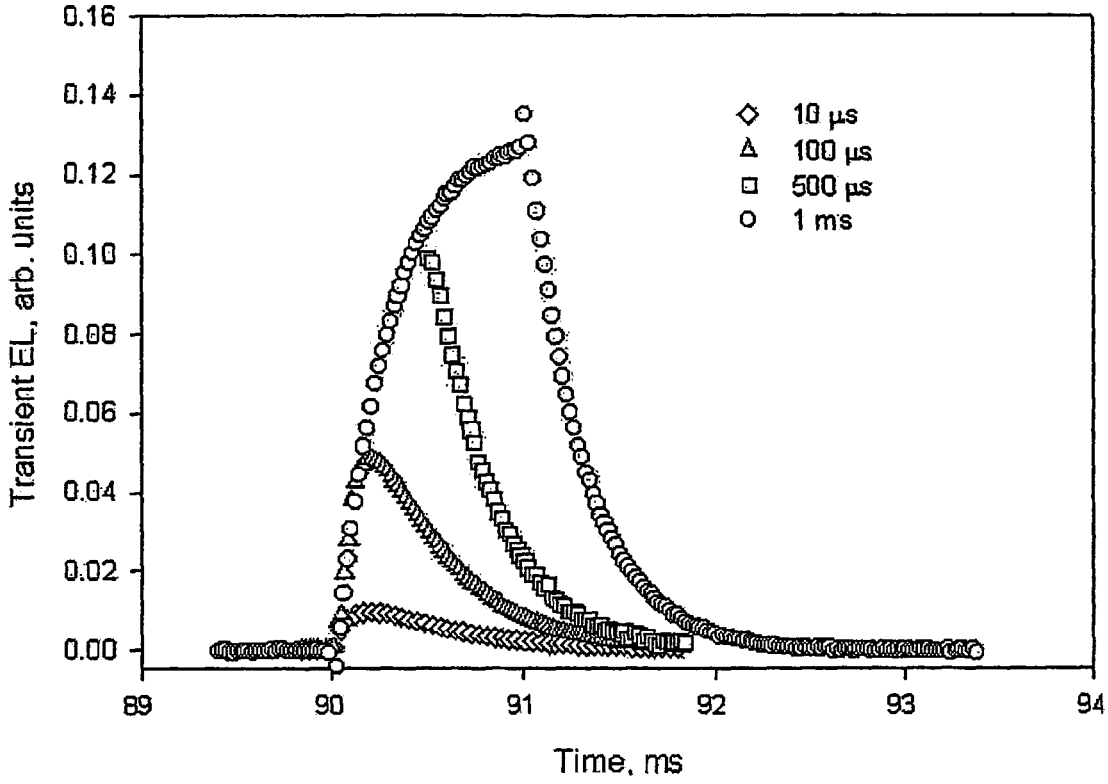
FIG. 2 illustrates the transient EL emission from the device prepared in Reference Example 1 with a fixed current density of 500 mA/cm$^2$ and a pulse duration varying from 10 μs to 1 ms.
Figure 3:
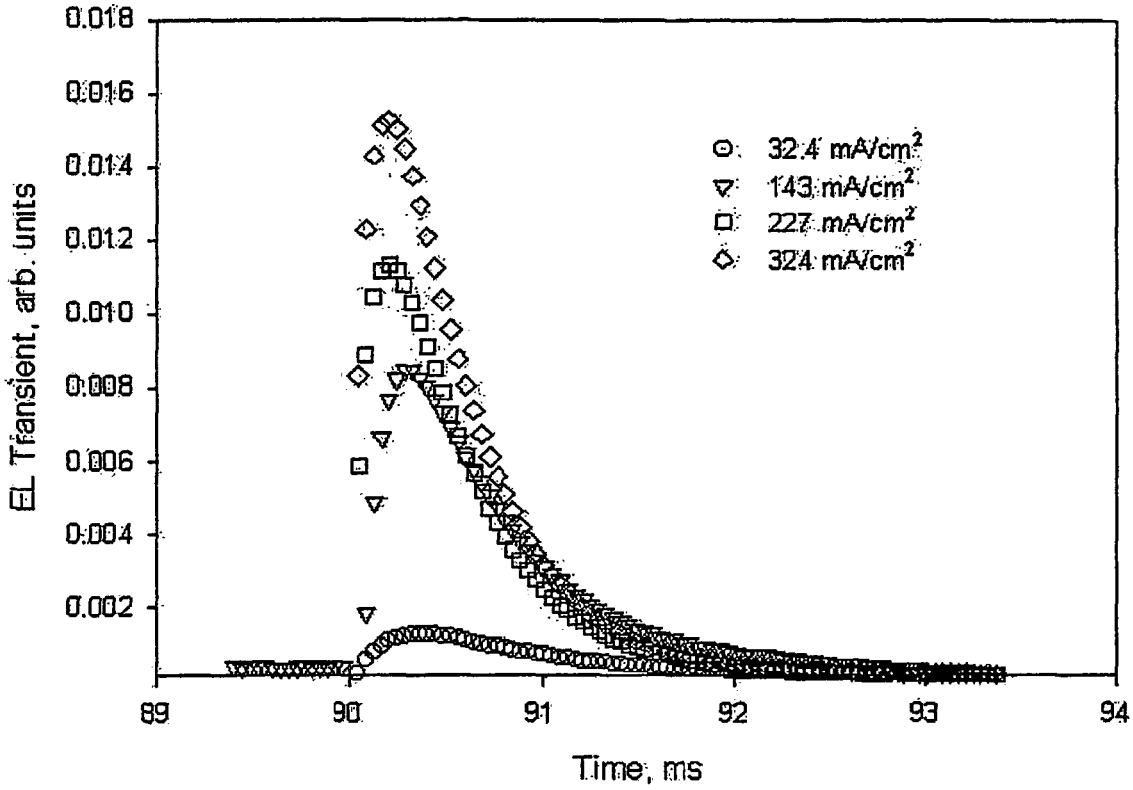
FIG. 3 illustrates the transient EL emission from the device prepared in Reference Example 1 with a fixed pulse duration of 10 μs and a current density varying from 32.4 to 324 mA/cm$^2$.

The results of the pulsed driving are presented in FIGS. 2 and 3. In FIG. 2 the magnitude of the current pulse was kept constant at 500 mA/cm$^2$ while the duration of the pulse was varied from 0.01 to 1 ms. In FIG. 3 the current pulse duration was fixed at 0.01 ms and the magnitude of the current pulse was varied from 32.4 to 324 mA/cm$^2$.

Whilst transient EL in the fluorescent materials closely follows the shape of the driving current pulse, the EL rise and the fall times for both transition metal and lanthanide phosphorescent materials depend on the phosphorescence lifetime. As seen from FIGS. 2 and 3, a long afterglow that lasts longer than 2 ms is present in the EL transient. This afterglow is a result of the 0.5 ms radiative lifetime of the excited $Eu^{3+}$ ion in the $Eu(TTA)_3$phen complex.

Figure 4:
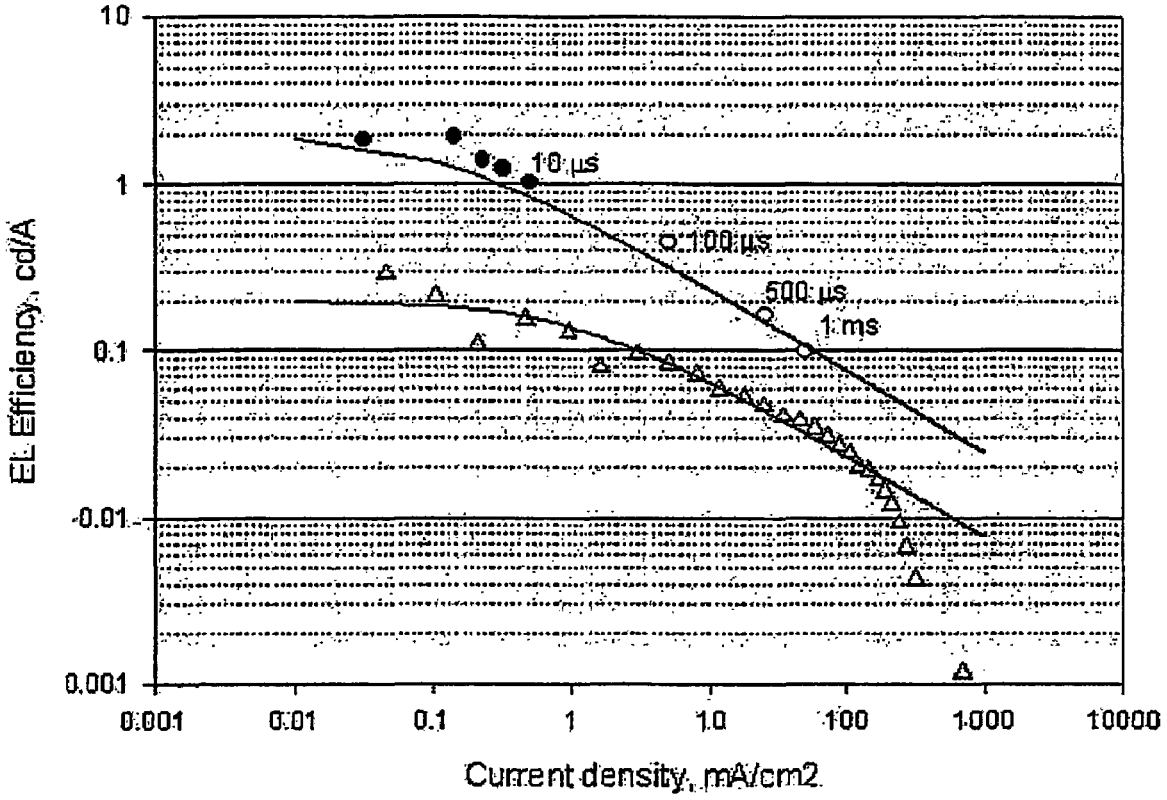
FIG. 4 illustrates the dependence of quantum efficiency on average current density for the device prepared in Reference Example 1 with steady state driving (triangles) and pulsed driving (circles)

The amount of light generated per pulse was calculated by measuring the area under the transient EL signal. Relative quantum efficiencies were estimated from the ratio of the area of the EL transient to the area of the current pulse. According to the data, the efficiency of the EL emission goes up by an order of magnitude while the duration of the applied 500 mA/cm$^2$ current pulse is reduced from 1 ms to 10 μs. When the duration of the current pulse was fixed at 10 μs and the magnitude of the current pulse was varied from 32 to 324 mA/cm$^2$, the relative EL efficiency at high current densities dropped by a factor of two. Efficiency curves are presented in FIG. 4, where the results obtained with steady state and pulsed driving are represented as triangles and circles, respectively. It can be seen that the pulsed mode pulsed mode efficiency plotted as a function of average current density (peak current density corrected for the duty ratio) is higher than the steady state EL efficiency by one order of magnitude.

EXAMPLE 2

An organic electroluminescent device was prepared containing $Eu(TTA)_3$phen as the phosphorescent light emitter. The device consisted of 4,4'-bis(carbazole-9-yl)biphenyl (CBP) doped with $Eu(TTA)_3$phen as an emitting layer, BCP as a hole blocking/electron transporting layer, and LiF/Al as a cathode.

Figure 5:
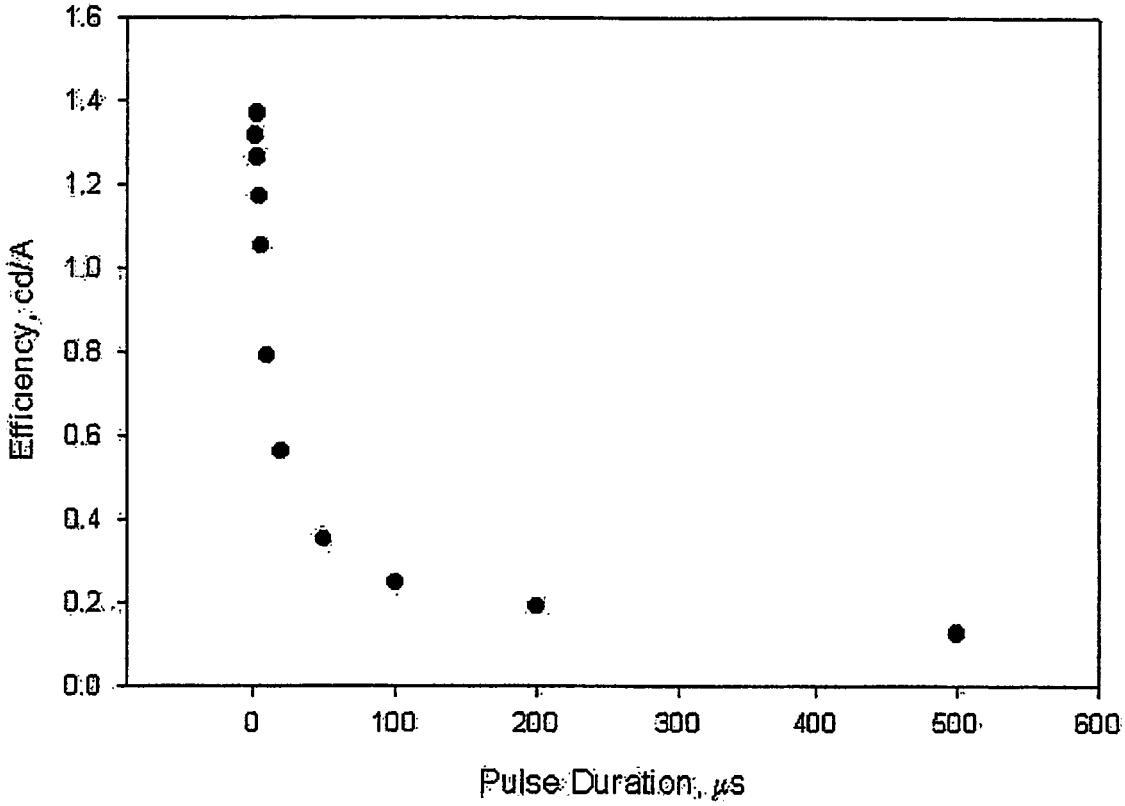
FIG. 5 illustrates the dependence of quantum efficiency on pulse duration for the device prepared in Example 2.
Figure 6:
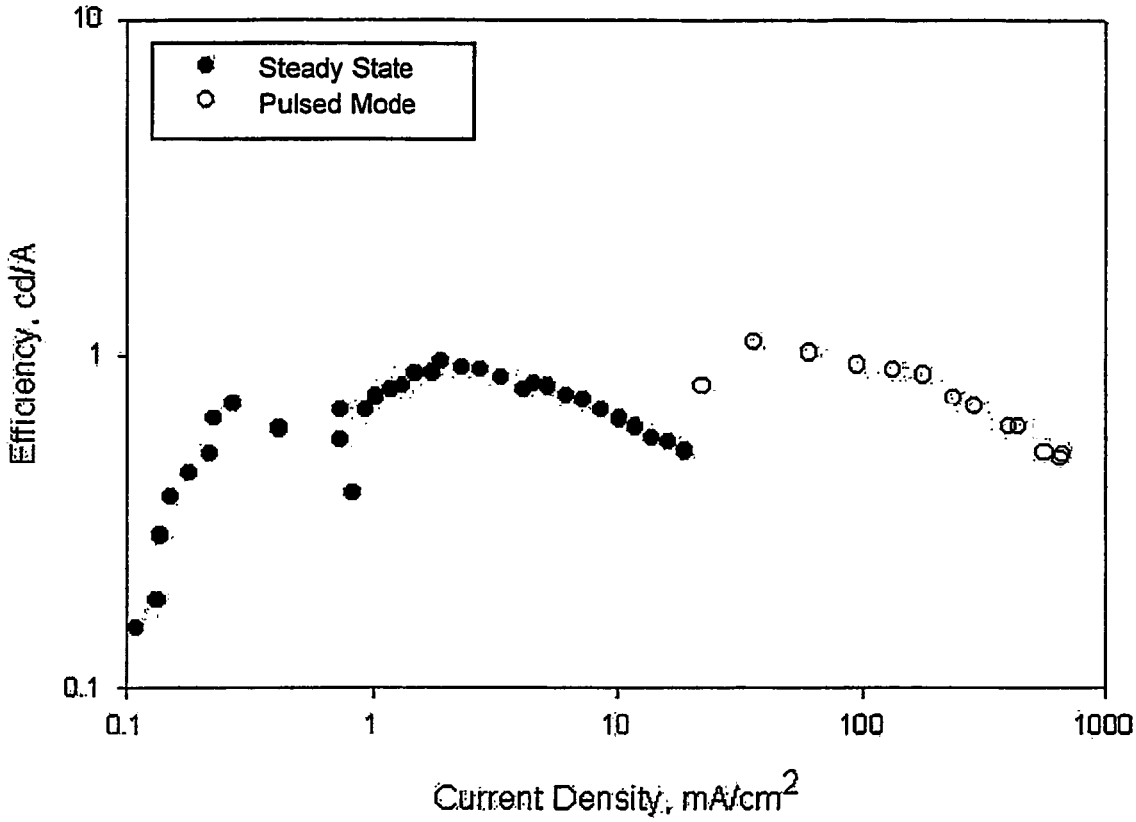
FIG. 6 illustrates the dependence of quantum efficiency on current density for the device prepared in Example 2 with both steady state and pulsed driving.

20V pulses were applied to the device. FIG. 5 shows the dependence of quantum efficiency on pulse duration at a fixed current density of 400 mA/cm$^2$, while FIG. 6 shows the dependence of quantum efficiency on current density for both steady state and pulsed driving.

Figure 7:
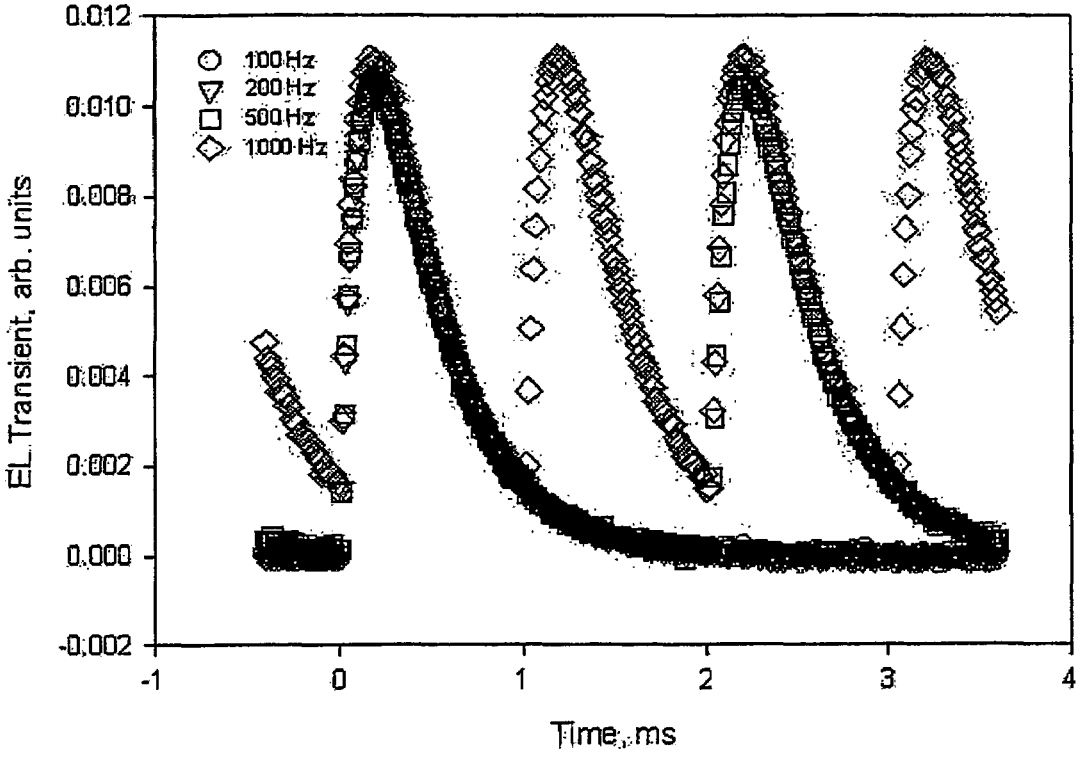
FIG. 7 illustrates the transient EL emission from the device prepared in Example 2 with a fixed pulse duration of 5 μs and a refresh rate varying from 100 to 1000 Hz.

FIG. 7 shows the effect on the transient EL emission of varying the frequency from 100 to 1000 Hz while fixing the pulse duration at 5 μs.

EXAMPLE 3

An organic electroluminescent device was prepared containing terbium tris(1-phenyl-3-methyl-4-(2-methylbutan-1-oyl)pyrazolin-5-one (Tb2B) as the phosphorescent light emitter. The device consisted of 20 nm thick CBP doped with Tb2B at about 10 weight % as an emitting layer, 60 nm of BCP as a hole blocking/electron transporting layer, and 1.2 nm LiF/100 nm Al as a cathode.

Figure 8:
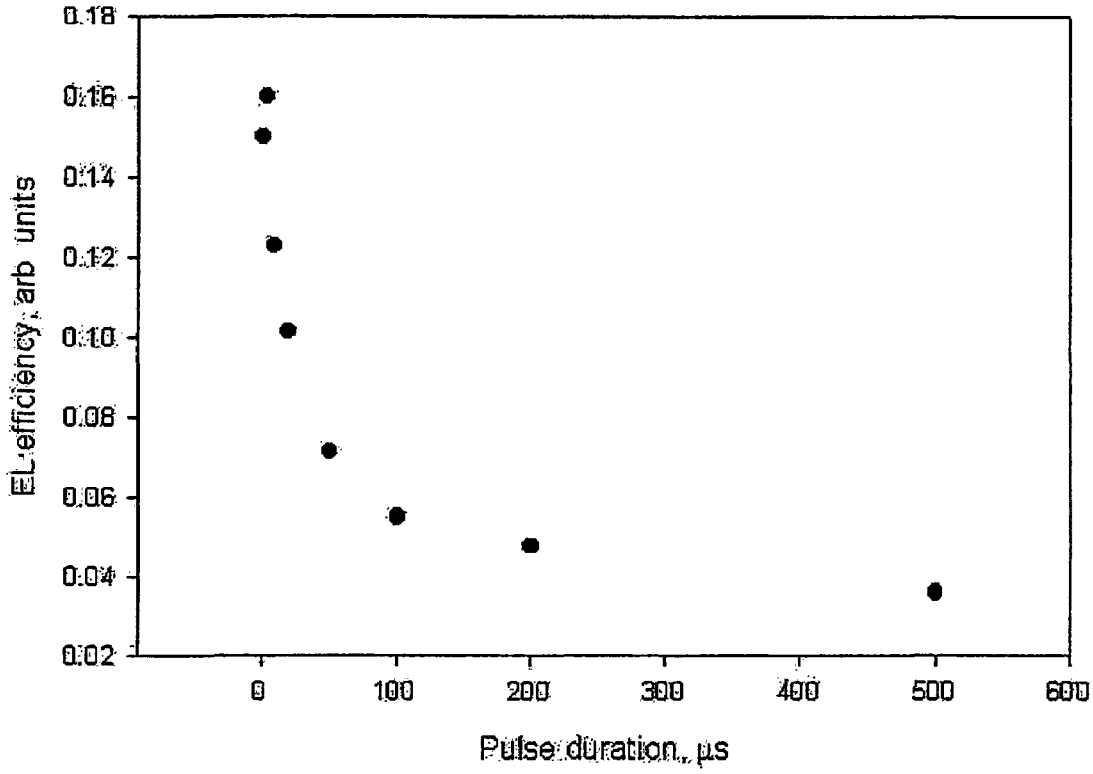
FIG. 8 illustrates the dependence of quantum efficiency on pulse duration for the device prepared in Example 3.

20V pulses were applied at a frequency of 100 Hz. The dependence of quantum efficiency on pulse duration is shown in FIG. 8.

EXAMPLE 4

An organic electroluminescent device was prepared containing 2,3,7,8,12,13,17,18-octaethyl-21H,23H-porphine platinum (II) (PtOEP) as the phosphorescent light emitter. The device consisted of 20 nm thick CBP doped with PtOEP at about 10 weight % as an emitting layer, 60 nm of BCP as a hole blocking/electron transporting layer, and 1.2 nm LiF/100 nm Al as a cathode.

Figure 9:
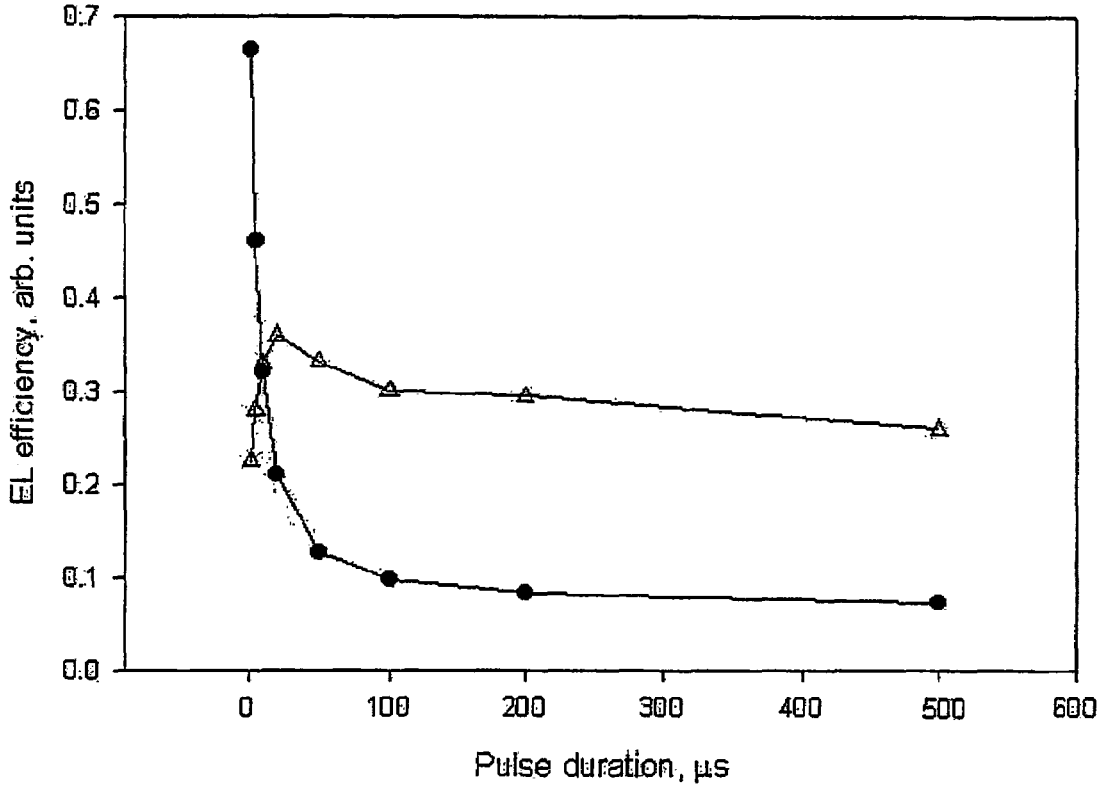
FIG. 9 illustrates the dependence of quantum efficiency on pulse duration for the devices prepared in Example 4 (circles) and Comparative Example 1 (triangles).

20V pulses were applied at a frequency of 100 Hz. The dependence of quantum efficiency on pulse duration is shown by the results plotted as circles in FIG. 9.

COMPARATIVE EXAMPLE 1

An organic electroluminescent device was prepared containing tris(8-quinolinolato)aluminium (III) ($Alq_3$) as a fluorescent light emitter. The device consisted of 50 nm of α-NPD as a hole transporting layer, 50 nm $Alq_3$ as an emitting layer, and 1 nm LiF/100 nm Al as a cathode.

14V pulses were applied at a frequency of 100 Hz. The dependence of quantum efficiency on pulse duration is shown by the results plotted as triangles in FIG. 9.

The invention claimed is:

1. A method of driving an organic electroluminescent device comprising a phosphorescent light emitter having an excited state emission decay time τ, which method comprises applying to the organic electroluminescent device a series of electrical pulses, each having a duration $t_d$, such that the ratio $t_d/\tau$ is less than or equal to 0.1 at a pulse frequency which is less than 1/τ.

2. A method according to claim 1, wherein $T_d/\tau$ is less than or equal to 0.05.

3. A method according to claim 1, wherein τ is from 0.05 to 1 ms.

4. A method according to claim 1, wherein td is less than or equal to 5 μs.

5. A method according to claim 1, wherein the electrical pulses are applied at a current density of from 0.1 to 100 mA/cm$^2$.

6. A method according to claim 1, wherein the electrical pulses are applied at a frequency of from 10 Hz to 1 kHz.

7. A method according to claim 1, wherein the phosphorescent light emitter is an organolanthanide phosphor compound.

8. A method according to claim 7, wherein the organolanthanide phosphor compound is a compound of formula (I):

$$M^{3+}(L^{n-})_xA_y \quad (I)$$

in which $M^{3+}$ is a trivalent lanthanide metal ion, $L^{n-}$ is an anionic ligand such that n.x is 3, A is an electrically neutral co-ligand which may be monodentate or bidentate, and y is 0, 1 or 2.

9. A method according to claim 8, wherein the organolanthanide phosphor compound is europium tris (2-thenoyltrifluoroacetone) 1,10-phenanthroline ($Eu(TTA)_3$phen).

10. A method according to claim 8, wherein the organolanthanide phosphor compound is terbium tris(1-phenyl-3-methyl-4-(2-methylbutan-1-oyl)pyrazolin-5-one (Tb2B).

11. A method according to claim 1, wherein the phosphorescent light emitter is 2,3,7,8,12,13,17,18-octaethyl-21H,23H-porphine platinum (II) (PtOEP).

12. A method according to claim 1, wherein the organic electroluminescent device is passively addressed.

* * * * *

UNITED STATES PATENT AND TRADEMARK OFFICE

CERTIFICATE OF CORRECTION

PATENT NO. : 7,642,996 B2
APPLICATION NO. : 10/488054
DATED : January 5, 2010
INVENTOR(S) : Salata It is certified that error appears in the above-identified patent and that said Letters Patent is hereby corrected as shown below:

Column 10, line 26, "T" should be -- t --

Signed and Sealed this

Sixteenth Day of March, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,642,996 B2
APPLICATION NO. : 10/488054
DATED : January 5, 2010
INVENTOR(S) : Oleg Victorovich Salata It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1238 days.

Signed and Sealed this

Sixteenth Day of November, 2010

David J. Kappos

David J. Kappos
*Director of the United States Patent and Trademark Office*